US006826942B2

(12) United States Patent
Bredal

(10) Patent No.: US 6,826,942 B2
(45) Date of Patent: Dec. 7, 2004

(54) APPARATUS AND METHOD FOR EXTRUSION OF MATERIAL

(75) Inventor: Torben Bredal, Gilleleje (DK)

(73) Assignee: Alex-Tech ApS, Allerod (DK)

( * ) Notice: Subject to any disclaimer, the term of this patent is extended or adjusted under 35 U.S.C. 154(b) by 0 days.

(21) Appl. No.: 10/241,828

(22) Filed: Sep. 11, 2002

(65) Prior Publication Data

US 2003/0070467 A1 Apr. 17, 2003

Related U.S. Application Data

(63) Continuation of application No. PCT/DK01/00174, filed on Mar. 15, 2001.

(30) Foreign Application Priority Data

Mar. 16, 2000 (DK) ..... 2000 00431
Aug. 7, 2000 (DK) ..... 2000 01178

(51) Int. Cl.[7] ..... B21C 25/00
(52) U.S. Cl. ..... 72/273
(58) Field of Search ..... 72/253.1, 255, 72/271, 273.5, 273; 11/478

(56) References Cited

U.S. PATENT DOCUMENTS

| | | | | |
|---|---|---|---|---|
| 3,563,079 A | | 2/1971 | Monie et al. | 72/255 |
| 3,919,873 A | | 11/1975 | Biswas et al. | 72/257 |
| 4,056,964 A | | 11/1977 | Shibasaki et al. | 72/273 |
| 4,430,877 A | | 2/1984 | Aasari et al. | 72/273.5 |
| 4,459,837 A | | 7/1984 | Hayashi et al. | 72/255 |
| 4,550,584 A | * | 11/1985 | Degen | 72/273 |
| 5,354,192 A | | 10/1994 | Soejima et al. | 425/190 |
| 5,626,047 A | * | 5/1997 | Bello | 72/273 |
| 5,918,498 A | * | 7/1999 | Robbins | 72/273 |

FOREIGN PATENT DOCUMENTS

| | | |
|---|---|---|
| DE | 2 234 666 | 2/1973 |
| DE | 25 56 394 | 6/1977 |
| DE | 3711752 | * 10/1988 |
| EP | 0 377 947 | 7/1990 |
| EP | 0 398 747 | 11/1990 |
| GB | 547080 | 8/1942 |
| GB | 2067944 | * 8/1981 |
| JP | 3-35811 | * 2/1991 |

OTHER PUBLICATIONS

Patent Cooperation Treaty International Preliminary Examination Report dated Jun. 18, 2002 for PCT Publication No. PCT/DK01/00174.

* cited by examiner

*Primary Examiner*—Ed Tolan
(74) *Attorney, Agent, or Firm*—Thomas R. Vigil; Welsh & Katz, Ltd.

(57) ABSTRACT

The apparatus for extrusion of material includes a process chamber provided in front of a die thereby serving to control parameters of the extrusion method. A die hold is provided to serve both as a structure for mounting a die in the front end of a hollow stem and a process chamber in front of a die. Preferably the process chamber is provided with structure for establishing resistance to the material to control the flow of material through the chamber. The control structure is adapted to serve both as a temperature regulating device for achieving an optimum temperature of the metal inside the process chamber and as a position controlling device for controlling the position of the metal inside the process chamber during the loading of a new billet.

5 Claims, 11 Drawing Sheets

1
2
2a
3
3a
4
5
6
7
8
8a
9

1
2
3
4
7
8
11
12
13
14

APPARATUS AND METHOD FOR EXTRUSION OF MATERIAL

CROSS REFERENCE To RELATED APPLICATIONS

This application is a continuation of PCT/DK01/00174 filed on Mar. 15, 2001 which claims priority from Danish Application No. PA 2000 00431 filed on Mar. 16, 2000 and Danish Application No. PA 2000 01178 filed on Aug. 7, 2000.

The present invention relates to equipment to be used in connection with an extrusion apparatus as well as corresponding methods for the extrusion of material; in a particular aspect it relates to a process chamber provided in front of a die thereby serving to control parameters of the extrusion process.

BACKGROUND ART

As a method for extruding a billet, i.e. a rod of a metal material to be extruded, direct extrusion has conventionally been prevailing due to the lower cost of tooling, however, in some cases the indirect extrusion method is adopted due to its merit of producing comparatively less friction loss in the course of an extrusion process.

The indirect extrusion method referred to herein means a method for extruding a billet through a tool in the form of a die without relative movement between the container and the billet. More specifically, indirect extrusion is a method in which an axially movable container, while accommodating a billet, is moved towards a die arranged in front of a stationary hollow die stem arranged concentrically with the container, a first end of the billet being forced towards the die by an extrusion or press ram.

Normally, on the circumferential surface of the billet there are impurities, which should be prevented from being extruded through the die as this would result in a finished product comprising these impurities. The outer portion of the billet comprising the impurities is known as the shell portion.

In order to solve this problem U.S. Pat. No. 4,459,837 proposes a die comprising a billet facing end portion having a slightly smaller diameter than the inner diameter of the through-going opening in the container, the resulting opening between the die and the inner surface of the container leading to a circumferential recess arranged on the peripheral surface of the die, the recess thus providing a circumferential space between the die and the container. In the course of extrusion, the shell portion is accommodated in the annular space between the die and the container wall. More specifically, in the disclosed embodiment the recess is provided with a plurality of axially arranged separating walls, thereby creating a plurality of recesses, for the purpose of dividing the flowed-in shell of the billet into pieces so that they may be removed easily.

After the extrusion of a billet, i.e. after each stroke of the container and press ram towards the stationary die, it is necessary to remove the shell impurities, which have accumulated in the recess. According to U.S. Pat. No. 4,459,837 this is done by using a free die which after the extrusion of a billet is removed from the end of the hollow stem. After removal the die is cleaned in order to remove the impurities, which have been collected in the recess, which is normally done by etching. As it is an object to run as many extrusion cycles per time unit as possible, it is necessary to provide a plurality of dies such that a cleaned die can be mounted in front of the hollow stem immediately after the container and press ram have been withdrawn in order to run a new extrusion cycle. Typically six dies are required.

As appears from the above, the known method requires that a plurality of dies specifically adapted for indirect extrusion is provided by the inclusion of a peripheral recess on each die. Further, for each extrusion stroke the die has to be removed, and subsequently cleaned, and a new, cleaned die mounted in front of the hollow stem.

Accordingly, it is an object of the present invention to provide improved extrusion methods and equipment therefore which meet one or more of the following requirements: Higher efficiency for running repeated extrusions, lower costs for tooling and dies, and lower associated costs.

It is another object of this invention to provide extrusion methods and equipment therefore wherein the life of the die and other parts is elongated by reducing the forces acting on the different structures.

Although the invention primarily addresses indirect extrusion, it will be apparent from the following that many aspects of the invention have corresponding relevance for direct extrusion.

DISCLOSURE OF THE INVENTION

Firstly, higher efficiency is achieved by a method and apparatus allowing the die to be effectively cleaned in a time-effective manner without having to remove it, this allowing for shorter periods between each effective extrusion stroke. In a further aspect, higher efficiency is provided by avoiding the need for removing the so-called residual, i.e. the rest of the billet positioned between the press ram and the die and the end of an extrusion stroke. Further again, cost-reduction is provided by an arrangement in which a single standard die can be used, i.e. the type of die normally used for direct extrusion and not being provided with a recess for collecting the shell portion of the billet.

More specifically, according to a first aspect of the present invention, a process chamber is provided in front of the die serving to control parameters of the extrusion process. In a preferred embodiment a die holder is provided which serves both as a means for mounting a die on the front end of a hollow stem as well as provides a process chamber in front of the die during extrusion. The die holder comprises recess means at its leading end, i.e. the end facing the billet and comprising an inlet opening, this allowing a standard die to be used. The recess means may be in the form of the above-described circumferential recess or a plurality of recesses separated from each other. Although the term diameter traditionally is used to describe such a circumferential structure, in the context of the present application, diameter is also used to describe the relative dimensions of non-circular structures. These considerations also apply to the term bore.

In a further preferred embodiment the process chamber is provided with means for controlling the flow through the chambers inlet opening, for example in the form of resistance means arranged in the inlet opening. More specifically, such a control means can be adapted to serve both as a temperature regulating means for achieving an optimum temperature of the metal inside the process chamber, as well as controlling the position of the metal inside the process chamber during loading of a new billet, i.e. controlling the above-described residual. To control the position of the residual is an important aspect, as a melted residual would otherwise tend to flow out of the chamber. Depending on whether the chamber is to be used for direct or indirect extrusion, the resistance means may be used with or without the shell-collecting recess.

Controlling the temperature as described above has a number of advantages. During extrusion most of the heat necessary for providing a given desirable process temperature for the metal to be extruded through the opening in the die is produced as a consequence of shear forces as the metal is deformed and made to flow in given directions. Normally, the largest contribution to heat generating takes place as the metal is forced through the opening in the die or around bridge inserts arranged close to the die opening, however, this results in substantial wear on the die as well as the large forces necessary tend to deform the die. On the contrary, by providing heat build-up corresponding to the inlet portion of a process chamber, wear and the forces acting on the die can be considerably reduced. Further, by optimising the configuration of the heat generating means extrusion can take place at a lower pressure, which again results in less wear on the die as well as reduces the requirements as to the extrusion press as such.

In the context of the present application, the die, the chamber and other associated structures may be described as a die assembly, however, this term also covers embodiments in which the different components are formed integrally with each other.

According to a second aspect of the present invention, an improved dummy block is provided. As described above, the billet is forced towards the die by a press ram; however, normally an additional dummy block is interposed between the foremost end of the press ram and the trailing end of the billet. Due to the high forces exerted by the press ram the dummy block has a tendency to become attached to the billet, this resulting in a problem when the residual between the die and the press ram has to be removed after each extrusion stroke. According to U.S. Pat. No. 4,459,837 a free dummy block is used which is removed together with the residual (after this has been separated from the die) for subsequent cleaning. Another traditional method of freeing the dummy block from the residual is to apply some kind of adhesion preventing means, such as graphite, grease or soot, before a new billet is loaded. Although this method leaves impurities on the residual, this is normally not a problem as the residual, together with these impurities, is separated from the die.

In contrast to the above, the dummy block of the present invention allows for both easy separation from the residual as well as leaves a residual with a "clean" trailing end surface. Apart from the direct cost-savings from not having to clean or grease the dummy block, the dummy block of the invention also allows the residual to be "reused" in the subsequent extrusion stroke, i.e. in contrast to the traditional method of removing the residual, the leading end of a new billet is arranged in direct contact with the free end of the residual. It is evident, that considerable cost savings will be possible in this way. In a preferred embodiment, the dummy block is used in combination with a die holder and process chamber as described above, this allowing for control of the position of the metal inside the process chamber during loading of a new billet.

BRIEF DESCRIPTION OF THE DRAWINGS

In the following embodiments of the invention will be described, by way of example only, with reference to the appended drawings, in which.

DESCRIPTION OF PREFERRED EMBODIMENTS OF THE INVENTION

Figures 1, 2, 3:
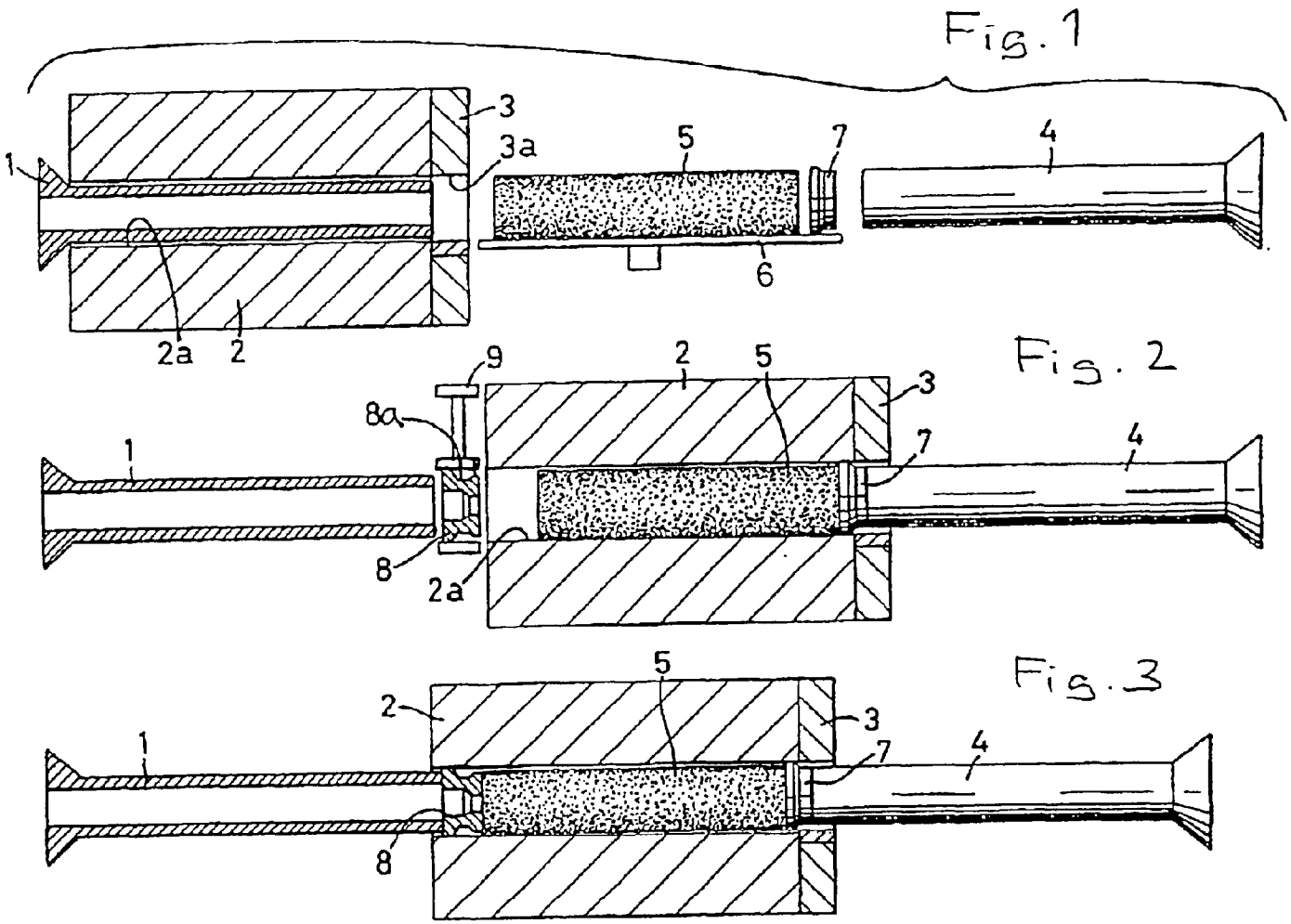
FIGS. 1–7 show schematic sectional views illustrating the different aspects of a prior art method of indirect extrusion.

To better understand the different aspects of the present invention, first a prior art method of indirect as known from U.S. Pat. No. 4,459,837 will be described with reference to FIGS. 1–7.

In each figure, numeral 1 designates a hollow die-stem, which is secured at the left side end thereof to a suitable stationary fixing means (not shown). A container 2 comprising a billet charging bore 2*a* is arranged concentrically and axially displaceable with respect to the die-stem 1. An extrusion or press ram 4 is arranged axially with respect to the die-stem and can be moved towards the die-stem by a press (not shown). On one end of the container 2 faced to the die-stem 1 a shear support 3 with an opening 3*a* is disposed as an independent body from the die-stem 1 but synchronously movable with the container 2.

Before extruding the billet 5 it is placed on the extrusion axial line, as shown in FIG. 1, by a suitable means, for example, by a billet loader 6 together with a dummy block 7 with an external diameter slightly smaller than the inner diameters of the billet charging bore 2*a* of the container 2. While the container 2 is shifted towards the press ram (FIG. 2) together with the shear support 3, the billet 5 on the loader 6 and the dummy block 7 are inserted into the billet charging bore 2*a* and the press ram, dummy block and the billet are brought into contact with each other.

Thereafter a die 8 is supplied by a die loader 9 onto the foremost end surface of the die-stem 1. The die is provided with an external diameter slightly smaller than the inner diameter of the billet charging bore 2*a*, thereby forming an annular space or recess 8*a* between the die and the wall of the bore, this for the purpose of receiving the outer layer or shell scraped off the billet 5 into the recessed clearance so as to remove it in the course of the extrusion.

The prior art die is only abutting on the end of the die-stem 1 and is not fixed by any means, but freely attached as in the conventional free die system.

After loading, the container 2 and the extrusion ram 4 are advanced together towards the die stem until the die is positioned in the bore of the container abutting on the billet 5 (FIG. 3). Thereafter a much greater force is applied to the extrusion ram 4 forcing the billet via the dummy block towards the die, the container at the same time being advanced at the same speed as the press ram. By this action the billet is gradually extruded through an opening in the die 8, thereby forming an extruded product 11.

Figures 4, 5, 6:
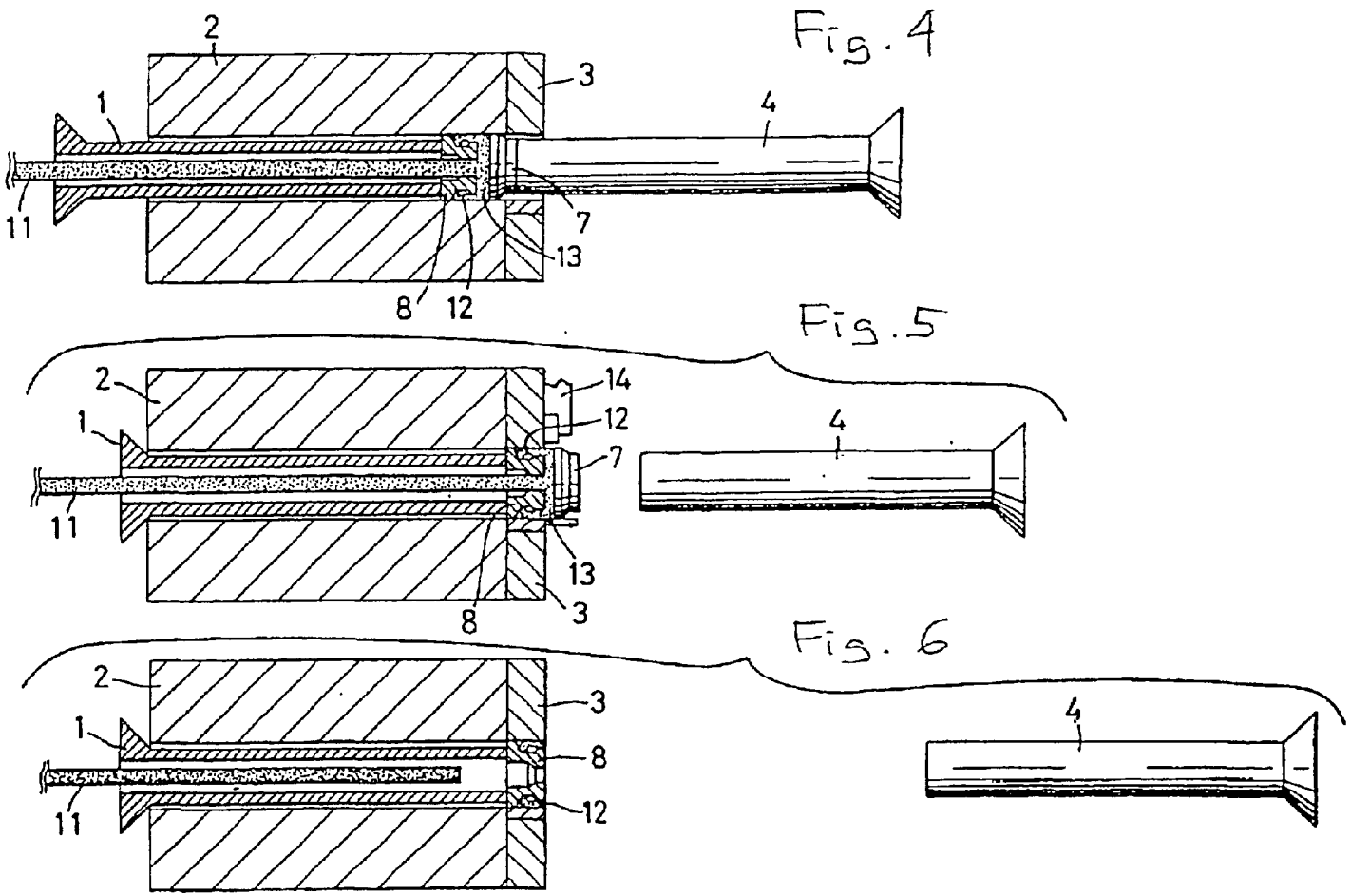

As the extrusion proceeds, the impurities located on the outer surface of the billet is forced through the small gap between the inner surface of the bore 2*a* and the leading end of the die for being accumulated in the above-described recess, the accumulated billet shell being denoted by reference numeral 12. The advancement of the container 2 and the extrusion ram 4 is halted with some residual 13 left as illustrated in FIG. 4, after which the extrusion ram is retracted and the residual 13 is projected from the container 2 due to further advancement of the container as illustrated in FIG. 5, whereby the die is positioned in the through-bore 3*a* of the shear support 3, which has been moved with the container. With the free end surface of the die 8 aligned with the outer surface of the shear support 3, the residual and the attached dummy block is removed by a shearing blade 14 which has been descended along the end surface of the shear support 3. The residual is subsequently removed from the dummy block 7.

Figure 7:
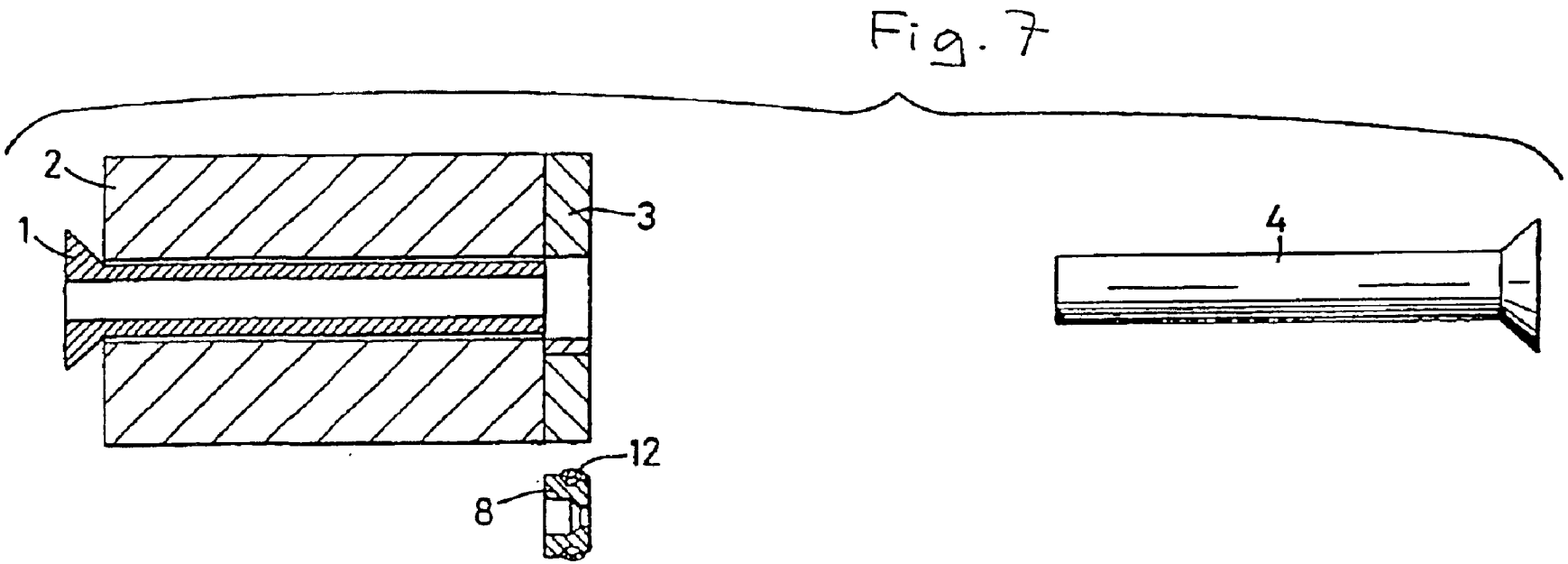

Parallelly to the severance of the discard from the die 8, the product 11 is pulled out of the die-stem 1 by suitable means (FIG. 6). The die left in the through-bore 3*a* is removed by suitable means with the accumulated billet shell 12 in the clearance 8*a* thereof (FIG. 7). The die 8 is subsequently cleaned by removal of the accumulated shell 12 by a proper means such as etching.

Figure 8:
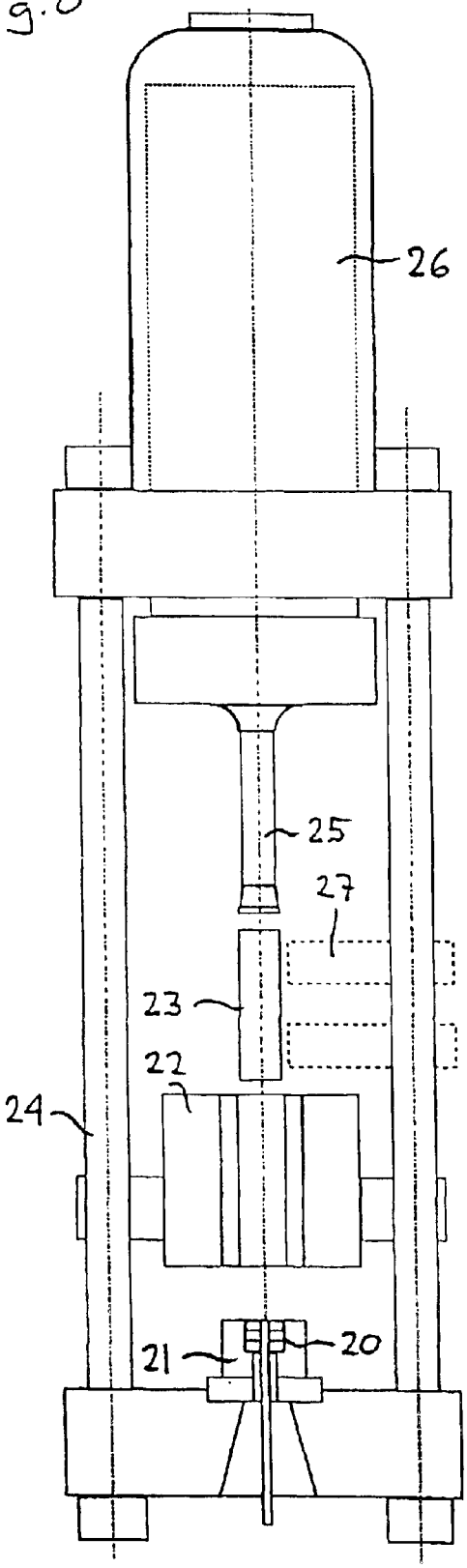
FIG. 8 shows an extrusion press for direct extrusion.
Figure 9:
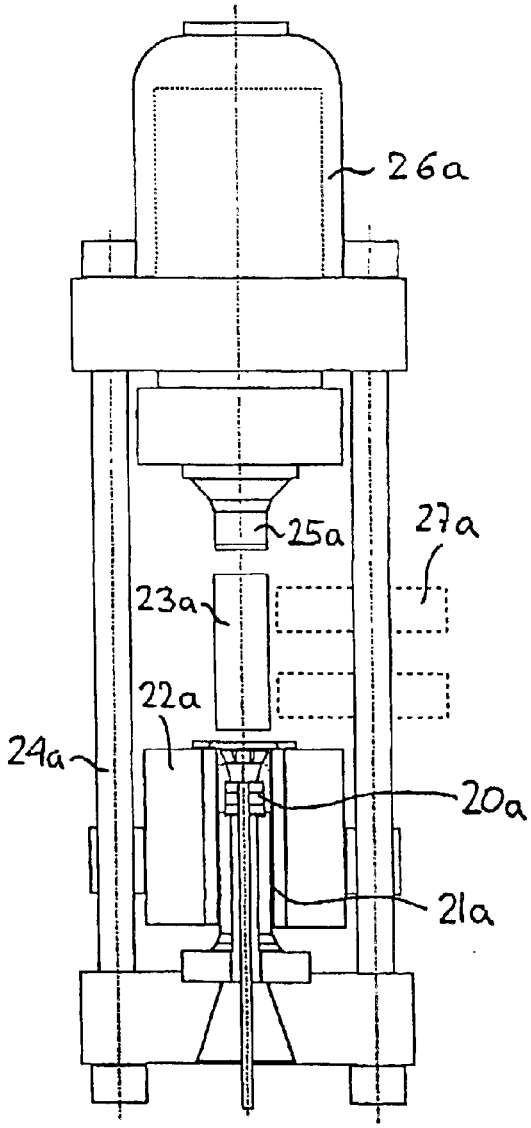
FIG. 9 shows an extrusion press for indirect extrusion.

As appears from the above description, the prior art method comprises several steps of handling and replacing the die, the dummy block and the residual, this in contrast to the present invention as will be apparent from the following. However, apart from these important aspects, the need for a number of dies, and furthermore dies especially adapted for indirect extrusion by incorporating a shell-collecting recess, is often the major consideration when deciding whether a given profile should be extruded by direct or indirect extrusion. If it was not for the high die-costs, it is believed that indirect extrusion would have a much higher preference as it has a number of advantages over the direct method as will be apparent from FIGS. 8 and 9 showing, respectively, an extrusion press for direct and indirect extrusion. The direct extrusion press comprises a die holder (or tool stack) 20 mounted on a hollow stem 21, a container 22 into which a billet 23 can be loaded by billet-loading means 27, the container being axially guided on supports 24, a press ram 25 driven by an extrusion means 26. In use the container is placed against the die, a billet is loaded and the press ram is moved into the container which is stationary during extrusion, the forward movement of the press ram causing the billet material to be extruded through the die. Principally, the indirect extrusion press comprises the same components denoted by the suffix "a", however, as it appears, the hollow stem 21*a* is much longer and the press ram 25*a* is much shorter, this being due to the inherent properties of the indirect extrusion method as described above. As it appears from the drawings, for extruding a given profile, the direct extrusion press is much larger, both with regard to the "travel" dimensions as to the press means needed, the latter being due to the much larger force needed to overcome the resistance when the billet is moved relatively to the container.

As follows from the above, it would be of great relevance, if a given die for a (standard) direct extrusion method could also be used in indirect extrusion.

Figure 10:
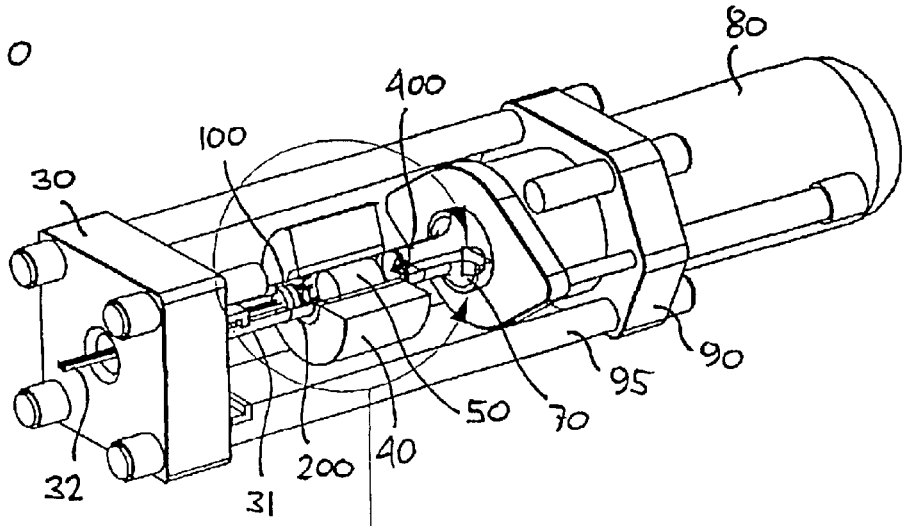
FIG. 10 shows an extrusion press for indirect extrusion incorporating features of the present invention.
Figure 11:
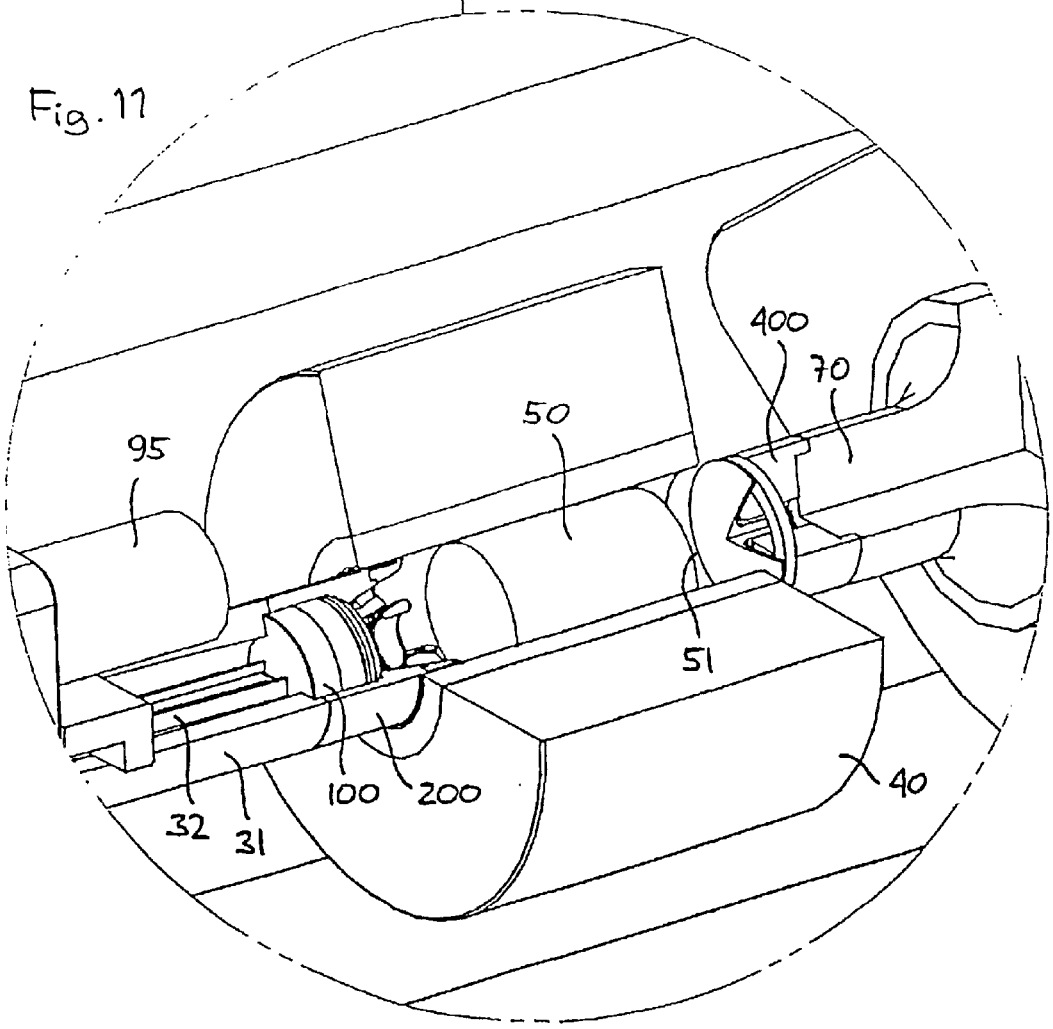
FIG. 11 shows an enlargement of a portion of FIG. 10.

Next, with reference to FIG. 10, a preferred embodiment of the present invention will be described. The extrusion press comprises a stem-carrying portion 30 onto which is attached a hollow stem 31 carrying a die 100 mounted onto the stem by means of a die holder 200 (which will be described in greater detail below), a container 40, with a through-opening, being axially displaceable on guiding means (not shown) and a billet 50 arranged therein, and a dummy block 400 attached on a press ram 70 driven by a press 80 mounted on a press-carrying portion 90, the stem-carrying portion and the press-carrying portions being connected by longitudinal posts 95 (one of which is shown cut for illustrative purposes). An extruded profile 32 is situated inside the hollow stem. In FIG. 11 it can be further seen that the die holder 200 comprises a resistance means 300 arranged in front of the die, and that the container 40 is provided with a liner 41 defining the wall of the through-opening in the container. The dummy block comprises a leading face adapted to be placed in contact with a trailing end 51 of the billet.

Figure 12:
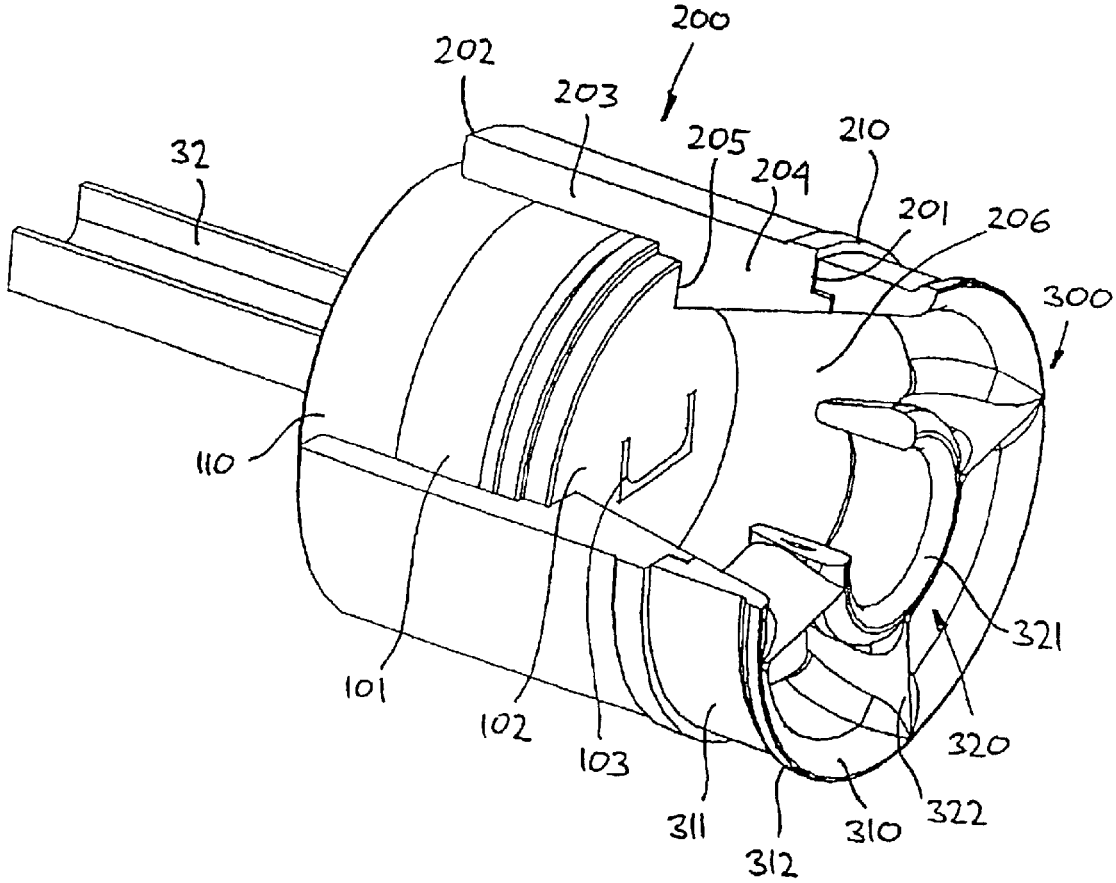
FIG. 12 shows a die holder in accordance with aspects of the invention.

With reference to FIG. 12 the die holder 200 will be described in greater detail. The tool 100 (also called a die) to be mounted on the hollow stem (not shown here) comprises a generally cylindrical body 101 with a front end surface 102 and a through-going 103 opening having a configuration corresponding to a desired profile to be extruded there-through. In the shown embodiment the foremost portion of the cylindrical body has some smaller-diameter portions allowing for better fixation by the die holder, just as a tool or die support 110 (or more) is arranged between the die and the hollow stem. The die holder 200 comprises a generally cylindrical body with an outer surface, a front end 201, a rear end 202 and a through-going opening, the front end defining an opening through which the material to be extruded passes, and the rear end defining an opening into which the die is positioned. The through-going opening has a rear constant diameter portion 203 accommodating the die 100 and a funnel-shaped front portion 204 with an outer larger diameter and a smaller inner diameter forming a process chamber 206, the stepped configuration between the innermost portion of the chamber and the rear portion 203 providing a surface 205 acting as a gripping means for holding the die on the hollow stem. Corresponding the front end of the outer surface of the die holder, a ring member 210 is formed and adapted to be in sliding engagement with the inner wall of the container 40. Due to the funnel-shaped configuration deformation of the billet material takes place as it is forced towards the die opening, this helping to heat and thereby soften the material before the final deformation work takes place by extrusion through the die opening 103.

In front of the die holder and attached thereto is arranged a ring element 300 which in the shown embodiment comprises two components serving two different purposes.

Figure 22:
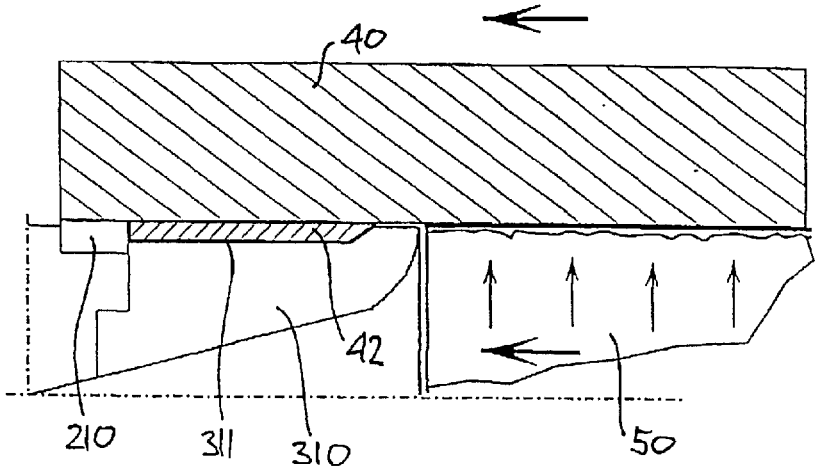
FIG. 22 shows in detail the shell-collecting recess of the die holder.

Firstly, a ring member 310 provides a funnel-shaped extension of the above-described process chamber as well as provides a recess for accumulating the shell portion of the billet during extrusion. The recess is defined between the outer circumference 311 of the ring member 310 and the inner wall of the container. The recess, when positioned in the container, is closed at the rear end corresponding to the ring member 210 and is open at the front end, the opening into the recess being defined between the leading, billet facing end portion 312 of the ring member having a slightly smaller diameter than the inner diameter of the through-going opening in the container, the resulting opening between the ring member and the inner surface of the container leading to the circumferential recess. From the prior art it is well known that the explicit configuration of the leading ring member portion 312 should be chosen, in accordance with the given conditions (for example the material to be extruded and the extrusion pressure used), such that the shell 42 portion actually is directed into the recess, this as illustrated in FIG. 22. Advantageously, the recess may be provided with a plurality of axially arranged separating walls (not shown), thereby creating a plurality of recesses, for the purpose of dividing the flowed-in shell of the billet into pieces so that they may be removed easily. Further, in a preferred embodiment, the walls have the same radial extension as the ring member 210 such that the ring member is supported against radial forces exerted during extrusion. In order to prevent the collected shell material to become attached to the recess surface, the recess, and preferably the entire die assembly, should be surface-treated as described below with respect to the dummy block.

As also indicated above, in the context of the present application, the term diameter is also used to describe the relative dimensions of non-circular structures. For example, when extruding large "flat" profiles, which is often the case for example in the automobile or aeroplane industry, the billet and the corresponding equipment used may have an oval-like cross section with opposed coplanar surfaces.

Secondly, a resistance member 320 is arranged in the opening of the ring member 310, thereby "closing" the process chamber. The resistance member serves two purposes as it on the one hand helps heating the billet material as it is forced around the different elements of the resistance member 320, and on the other hand prevents the very hot, almost molten material in the process chamber from "escaping" during retraction of the dummy block and loading of a new billet. In the prior art it is well known to provide a male die member in front of a female die member in order to provide, in combination, a ring-formed die. Normally, the male die member is carried by a bridge spanning the room in front of the female die member, and although this arrangement to some extent will result in additional heat build-up, the bridge member will have to be arranged just in front of the female die, this in contrast to the present invention, in which the resistance member is placed corresponding to the inlet portion of a process chamber. Preferably, the foremost (or front-most) portion of the resistance member and the die holder lie substantially in the same plane perpendicular to the general extrusion axis, this allowing the dummy block to abut on both the resistance member and the die holder.

In the shown embodiment the resistance member comprises an inner ring 321 carried by a number of supports 322, however, the resistance member could have any configuration serving the above purposes, in fact, any element arranged in the chamber inlet opening or protruding into the inlet opening could serve as a resistance member.

As appears from FIGS. 11 and 12 the "combined" die comprises four members, a hollow stem 31, a die 100 arranged in front thereof, and a die holder for attaching the die on the hollow stem, the die holder comprising a cylindrical hollow body 200 in front of which is arranged a resistance member. Although these members are described as separate members, they may be provided in any desired "fixed" constellation. For example, the resistance member may be formed integrally with the hollow body or it may be permanently attached by welding or the like. Correspondingly, the hollow body could be formed integrally with the die which on its outside may also comprise the recess for collecting the shell; indeed, this would necessitate a die specifically made for indirect extrusion.

The different members may be attached by any suitable means, for example, the die holder body 200, as well as the resistance ring 300, may be attached by long bolts forwarded by bores through the hollow stem and fastened to the die holder, thereby holding the die in place. The die holder could also be attached to the hollow stem by external clamping means.

Figure 13:
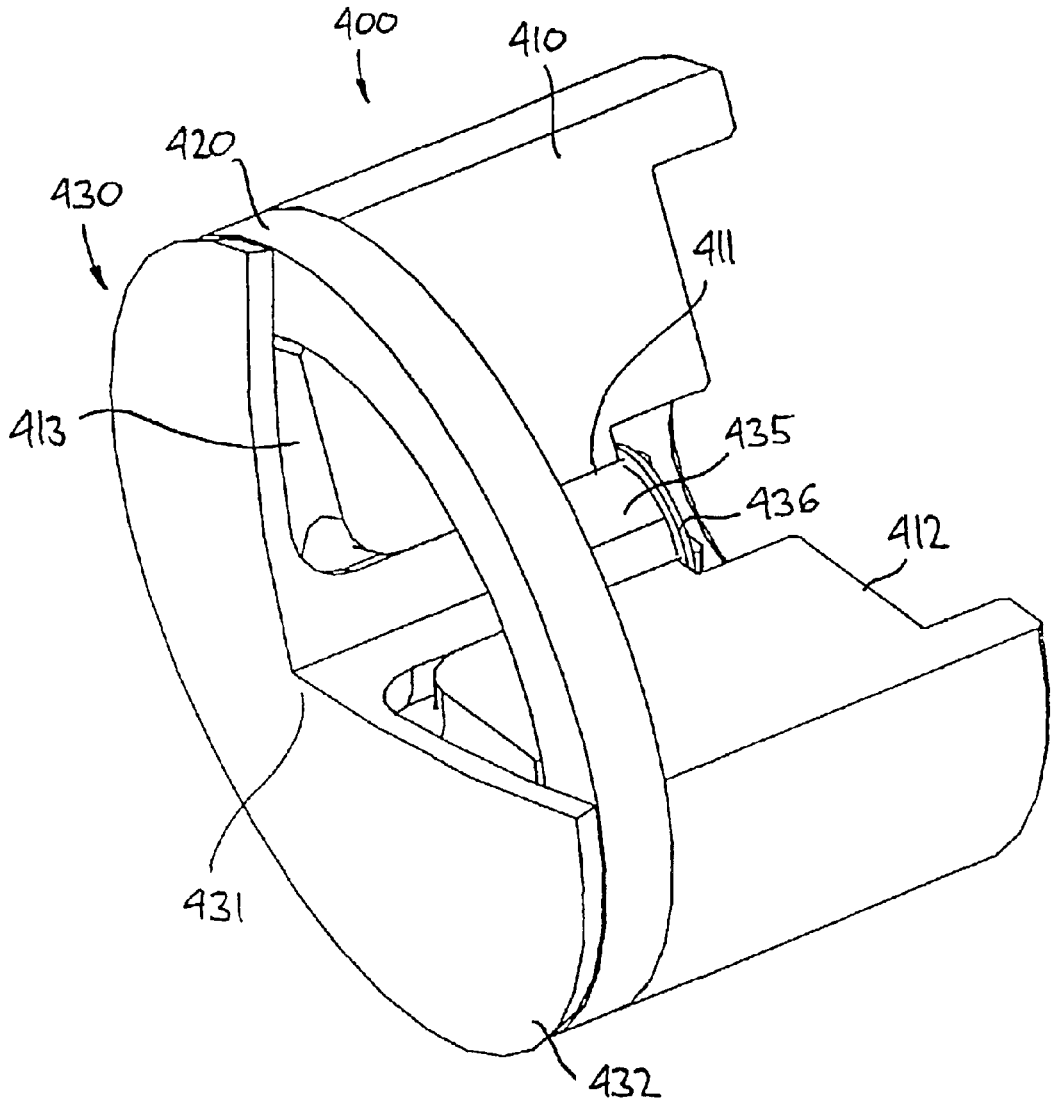
FIG. 13 shows a dummy block in accordance with a further aspect of the invention, a portion being cut away for illustrative purposes only.
Figure 14:
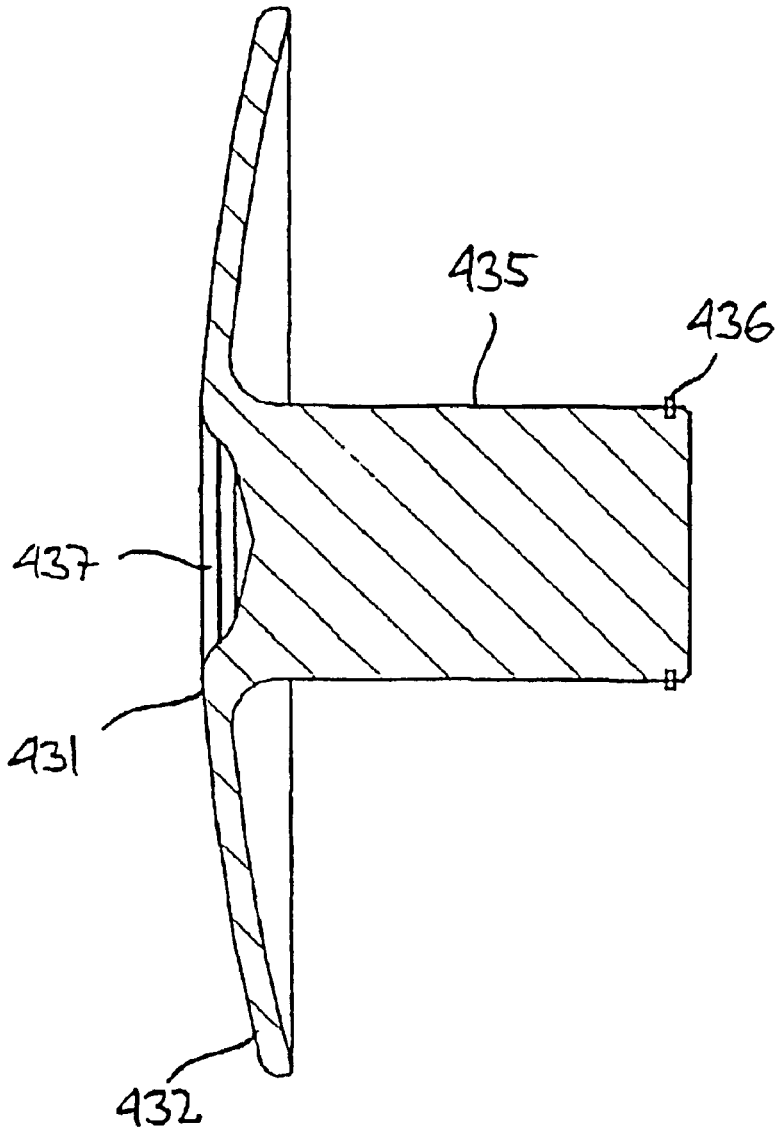
FIG. 14 shows a section through a press disk to be used in combination with a dummy block.

Next, with reference to FIGS. 13 and 14, the second aspect of the present invention will be described. FIG. 13 shows a dummy block 400 comprising a main body 410 with an axially arranged through-going opening 411, a support ring 420 and a press disk member 430 with a leading front surface and a rearwards protruding stem 435 axially displaceable arranged in the opening of the main body. The main body has a rear portion 412 adapted to be mounted on the press ram 70 and a front portion 413 accommodating the ring 420 in a peripheral recess, the ring serving both as a support for the disk member and as a reinforcement against outwardly directed forces on the main body during extrusion. As appears from FIG. 13 the disk member is relatively thin having a generally curved configuration with the peripheral portions 432 sloping away from the central portion 431, this configuration allowing the disk member to elastically deform during the extrusion procedures when it is forced towards the trailing end of the billet. The object of the deformation is to provide a billet-engaging surface having a first non-deformed configuration in its relaxed state, and a second configuration when the extrusion pressure is applied to the billet, the billet-engaging surface returning to its relaxed configuration at the end of extrusion when the extrusion pressure is reduced to zero. In its relaxed state the disk has an external diameter slightly smaller than the inner diameter of the billet charging bore of the container, and an external diameter substantially corresponding to the inner diameter in its deformed state, however, depending on whether the dummy block is to be used in direct or indirect extrusion, the "deformed" external diameter has to be chosen correspondingly. More specifically, in direct extrusion the dummy block should merely slide on the internal surface of the container during extrusion, whereas in indirect extrusion the dummy block should preferably expand so as to lock to the container.

To prevent the disk member to detach itself from the main body when not under load, the stem 435 comprises a retaining ring 436 cooperating with the rear of the main body.

As the extrusion takes place at a very high pressure, the substantial deformation of the disk should correspondingly take place at such a high pressure, this providing a build-up of elastic deformation energy in the disk and thus a slip-function between the billet rear end and the disk. As is evident, such a slip-function allows the dummy block to disengage from the billet leaving a clean residual, which can then be re-used in the subsequent extrusion stroke.

Principally, the disk may have any desired form allowing it to deform and return to its non-deformed state, however, advantageously the non-deformed disk is generally convex towards the billet, this allowing the disk to slip first at the periphery thereof during relaxation. When used together with a process chamber as described above, this allows the exposed residual to cool from the periphery thereof, this leaving a free billet rear end with a "crust" which prevents the residual from flowing out of the chamber; indeed, the described resistance element will further prevent this from happening.

Depending on the actual curvature of the disk, very strong compression forces will build up towards the central portion of the disk, which may cause the material to fracture and brake down. To provide an improved distribution of the compression forces, the disk may advantageously be formed with a central concave "dimple" 437 as shown in FIG. 14.

To further enhance the slip-function, and to avoid the use of additional slip means, the billet-engaging disk surface may be treated to prevent the billet material from sticking, for example by treating the disk with PVD or plasma CVD, by ion-implanting, plasma-nitration or any other suitable tripological treatment.

With reference to FIGS. 15–21 a method for indirect extrusion will be described utilizing the novel features of the invention. The different figures comprise the same elements of an extrusion press as described in detail above, i.e. a stem-carrying portion 30 onto which is attached a hollow stem 31 carrying a die 100 mounted onto the stem by means of a die holder 200 defining a process chamber 206, an axially displaceable container 40, a billet 50, and a dummy block 400 attached on a press ram 70 driven by a press 80 mounted on a press-carrying portion. An extruded profile 32 is situated inside the hollow stem. The die holder 200 comprises a resistance means 300 arranged in front of the die. As appears, all elements are arranged co-axially corresponding to an extrusion axis of the press.

Figure 15:
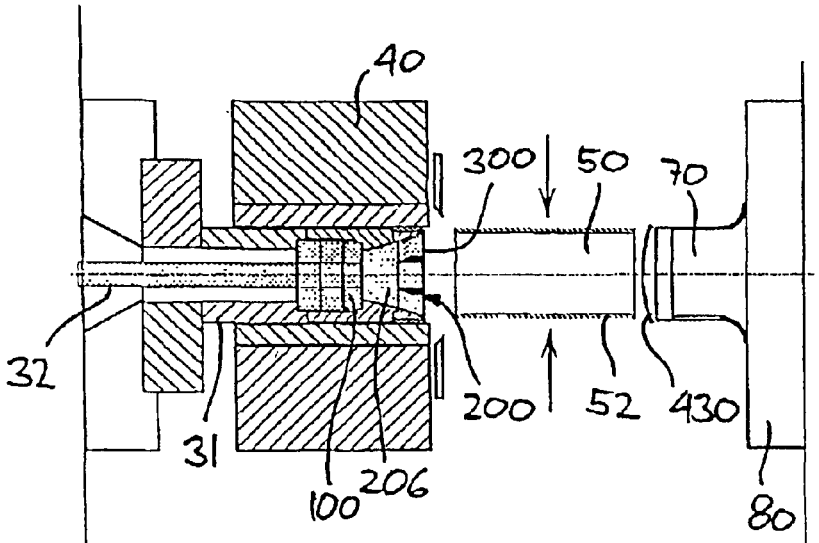
FIGS. 15–21 show schematic sectional views illustrating a method of indirect extrusion incorporating different aspects of the invention.
Figure 16:
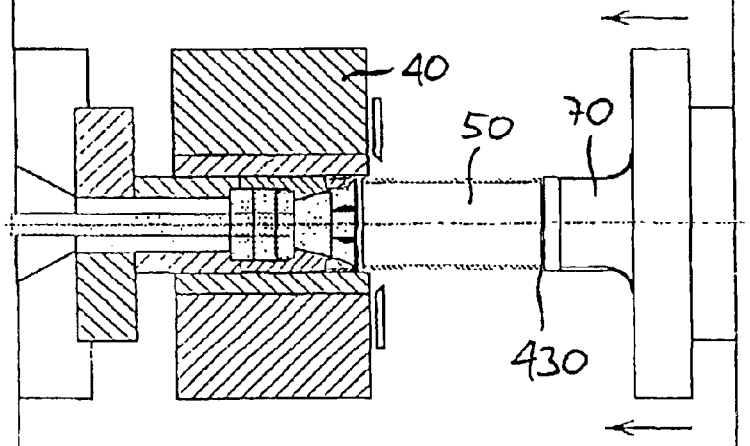

FIG. 15 shows the situation after an extrusion stroke has taken place and a new billet 50 (with a shell 52) has been introduced into the press and aligned (or centred) corresponding to the extrusion axis; more specifically, the container 40 is positioned concentrically around the hollow stem 31 and the process chamber 206, the shell has been removed from the die holder and the press ram 70 has been withdrawn. As can be seen, the billet engaging press disk 430 of the dummy block is in its relaxed curved state.

Figure 17:
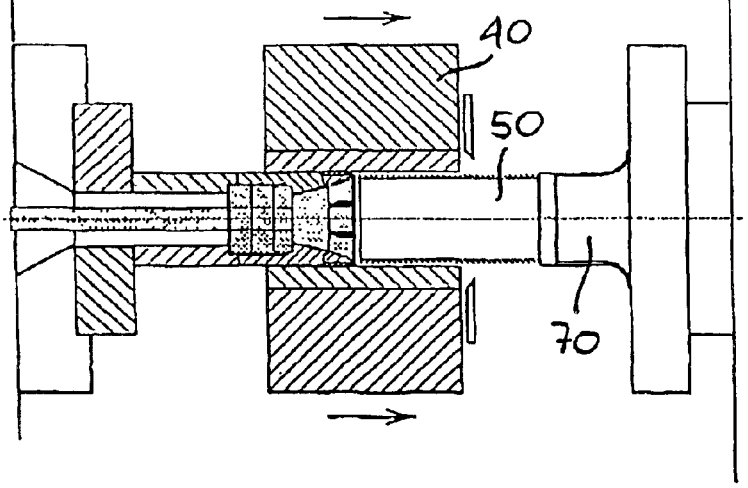
Figure 18:
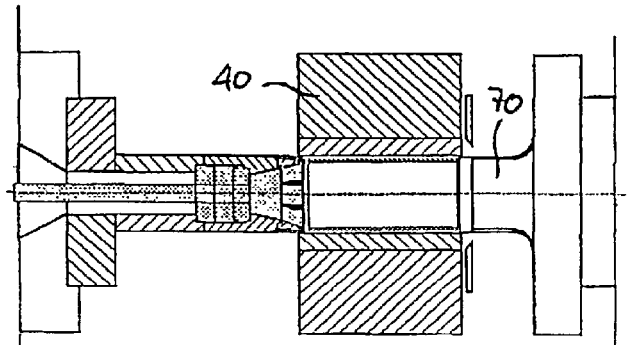

As the next steps the press ram is moved towards the billet, this resulting in the disk being deformed to a flattened state in full contact with the rear end of the billet, which is forced against the foremost portion of the die holder (FIG. 16), and the container is moved to towards the press ram (FIG. 17) . FIG. 18 shows the situation just prior to start of the extrusion process, i.e. the front portion of the die holder (and thus the process chamber) is located just within the container, with the billet being fully situated within the container.

Figure 19:
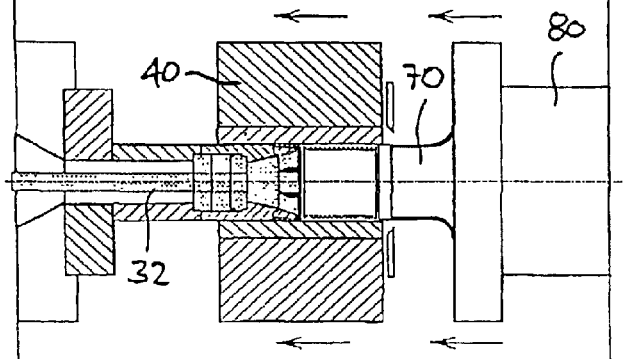
Figure 20:
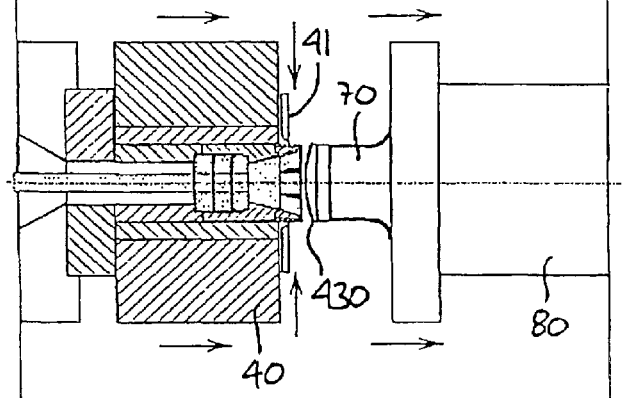
Figure 21:
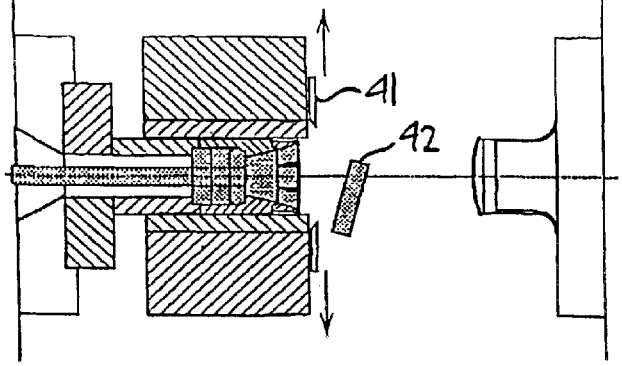

During extrusion, the press ram, and thus the billet, is advanced together with the container at the same speed towards the stationary die through which the extruded profile 32 is formed, this essentially representing the indirect extrusion method (FIG. 19).

Figure 23:
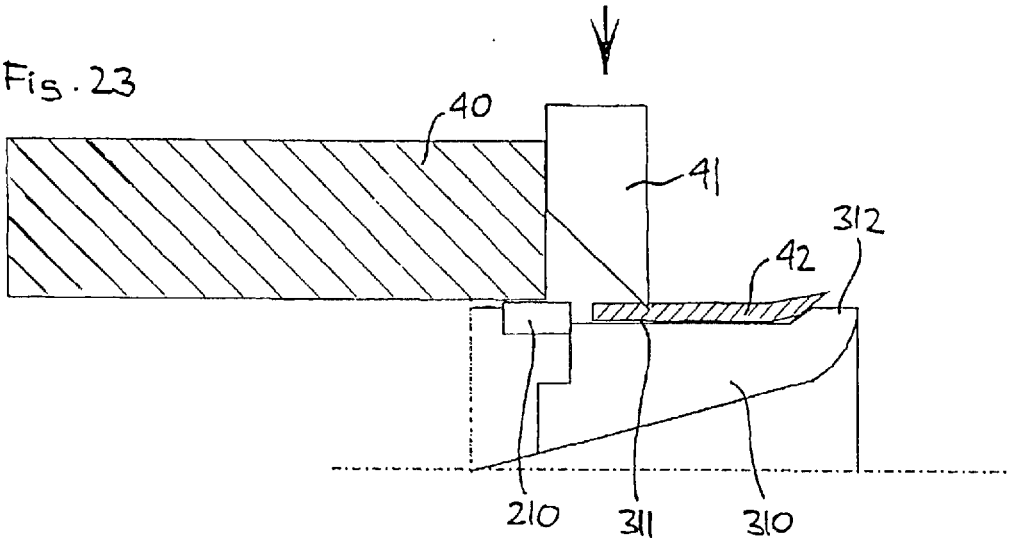
FIGS. 23 and 24 show gripping means removing the collected shell from the recess.
Figure 24:
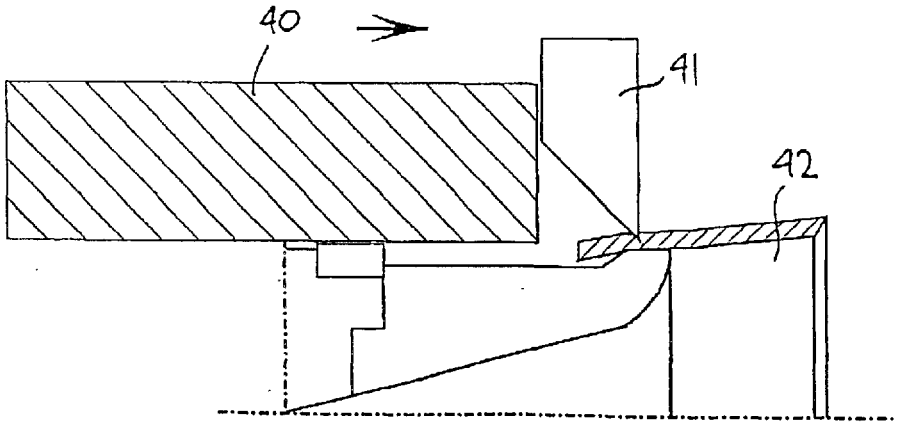

At the end of the extrusion stroke, the rearmost portion of the billet has been fully forced into the chamber through the resistance element, the press disk thereby abutting on the resistance element located corresponding to the inlet of the chamber. When the press ram is slowly withdrawn the press disk 430 starts to regain its unloaded configuration thereby slipping the residual from the periphery thereof. As explained above, due to the controlled slipping action and the provision of the resistance element the residual is essentially retained within the chamber and ready to be used in the next extrusion stroke, this in contrast to the prior art in which it had be removed and discarded. In order to remove the shell material collected in the die holder recess, the container is moved to expose the recess in order to allow gripping means 41, mounted on the container, to engage the ring-formed shell material (FIG. 20), after which the container is moved rearwards whereby the shell ring 42 is removed from the recess; the gripping means is subsequently retracted (FIG. 21) and the press is ready for a new billet to be loaded. The gripping and removing steps are shown in greater detail in FIGS. 23 and 24.

The shown method of removing the shell ring is only an example, in fact, any suitable means could be used to remove it, just as it may not be necessary to clean the recess for every stroke.

With reference to FIGS. 15–21 an embodiment has been described in which the novel press disk has been used in combination with a die holder comprising both a shell collecting recess and a resistance element, however, it is clear to the skilled person that each of these features can be used alone improving efficiency for an extrusion process; especially, the press disk and the chamber with the resistance element may be used also for direct extrusion.

What is claimed is:

1. A dummy block (400) adapted to be mounted on an end portion of a press ram (70), comprising:

a disk member (430) with a front surface (431, 432) adapted to engage an end of a billet, the disk member being elastically deformable and having a generally convex front surface directed toward the billet in a first configuration in a non-deformed state and a generally planar surface in a second configuration in an elastically deformed state when the disk member is forced against the end of the billet by the press when mounted thereon.

2. A dummy block as defined in claim 1, wherein the disk member, in the deformed state, comprises a centrally arranged concave portion (437).

3. A dummy block as defined in claim 1, further comprising a main body (410) having a forwardly arranged opening (411), the disk member comprising a rearwards protruding stem (435) axially displaceable arranged in the opening of the main body.

4. A dummy block as defined in claim 1 wherein said disk member is thin and has a generally curved configuration with a leading central front portion and rearward sloping peripheral portions.

5. A dummy block as defined in claim 1 wherein said disk member has a rearwardly protruding stem.

* * * * *